US007913592B2

(12) United States Patent
Hu

(10) Patent No.: US 7,913,592 B2
(45) Date of Patent: Mar. 29, 2011

(54) TOOL HOLDING DEVICE

(76) Inventor: Bobby Hu, Taichung (TW)

( * ) Notice: Subject to any disclaimer, the term of this patent is extended or adjusted under 35 U.S.C. 154(b) by 223 days.

(21) Appl. No.: 12/331,544

(22) Filed: Dec. 10, 2008

(65) Prior Publication Data

US 2010/0031787 A1 Feb. 11, 2010

(30) Foreign Application Priority Data

Aug. 6, 2008 (TW) ..... 97129954 A

(51) Int. Cl.
*B25B 23/00* (2006.01)
*B25B 15/00* (2006.01)

(52) U.S. Cl. ..... 81/438; 81/177.85

(58) Field of Classification Search ..... 81/438, 81/177.85; 173/132; 279/24, 29, 76, 79, 279/82

See application file for complete search history.

(56) References Cited

U.S. PATENT DOCUMENTS

| | | | | |
|---|---|---|---|---|
| 5,934,384 | A * | 8/1999 | Wang | 173/132 |
| 6,345,560 | B1 | 2/2002 | Strauch et al. | 81/477 |
| 6,481,315 | B1 * | 11/2002 | Chang et al. | 81/60 |
| 6,637,755 | B2 | 10/2003 | Chen et al. | 279/22 |
| 6,860,489 | B2 * | 3/2005 | Chen | 279/82 |
| 6,973,858 | B2 * | 12/2005 | Huang | 81/177.85 |
| 7,448,302 | B2 * | 11/2008 | Huang | 81/438 |
| 2007/0044596 | A1 * | 3/2007 | Chen | 81/125 |
| 2007/0234856 | A1 * | 10/2007 | Liu | 81/438 |
| 2009/0139379 | A1 * | 6/2009 | Chiang et al. | 81/438 |

* cited by examiner

*Primary Examiner* — David B Thomas

(74) *Attorney, Agent, or Firm* — Alam Kamrath; Kamrath & Associates PA

(57) ABSTRACT

A tool holding device is suitable to have an application with a power tool. The tool holding device includes a toolholder for receiving a bit. A sleeve is disposed outside the toolholder and is operable to move between a first position which allows for removal of the bit and a second position which allows the bit to be securely retained in the cavity of the toolholder. A returning member is disposed circumferentially between the toolholder and the second section of the sleeve for returning the sleeve to a neutral position between the first and second positions. Moreover, the portion of the sleeve which does not surround the returning member abuts the toolholder.

21 Claims, 19 Drawing Sheets

TOOL HOLDING DEVICE

BACKGROUND OF THE INVENTION

1. Field of the Invention

The present invention relates to a tool holding device for a bit and, in particular, the tool holding device is suitable to have an application with a power tool.

2. Description of the Related Art

U.S. Pat. No. 6,345,560 teaches a clamping chuck including a toolholder in which a bit is adapted to be received. Preferably, the bit has a shank of a standard hexagonal shape and a plurality of recesses disposed thereon. A clamping portion with a hexagonal cross section is connectable to a drive member. An actuating sleeve is connected to the toolholder and is utilized to maneuver a ball to selectively engage in and disengage from one of the recesses in the received bit. Thus, when the ball is engaged in one of the recesses, the received bit is securely retained in the toolholder, and when the ball is disengaged from the recess, the received bit is removable from the toolholder. It is appreciated that the actuating sleeve has a front end with a gradually decreasing outer diameter so if driving a fastener in a hole, a user may insert a portion of the front end of the sleeve which can clear the hole in order that the bit can engage with the fastener. However, if the front end is inserted in the hole and the bit still can't engage with the fastener, the user then has to use a bit with an elongated shank. Further, the user has to hold the elongated shank to alleviate a wobble of the bit during operation, particularly when the bit is rotated by a power tool rapidly.

Also, it is understood that when the received bit is allowed to be removed from the toolholder, the received bit can fall out of the toolholder due to gravity. Therefore, U.S. Pat. No. 6,345,560 teaches a magnet disposed in the toolholder adapted to relieve this problem. However, it is noted that the toolholder and other elements in the toolholder, any of which that are magnetizable, can scatter and, therefore, weaken the magnetic force. Thus, the magnet no longer provides sufficient force to hold the bit from falling out due to gravity.

Another chuck device for tool bits is disclosed in U.S. Pat. No. 6,637,755. However, this chuck device does not help the user reduce the demand of using a bit with an elongated shank.

In addition, U.S. Pat. No. 6,637,755 teaches a pusher utilized to facilitate removal of the bit received in the chuck device. However, if the user does not hold the bit, the bit will drop out of the chuck device. The user, then, has to pick up the bit which will result an inconvenience.

The present invention is, therefore, intended to obviate or at least alleviate the problems encountered in the prior art.

SUMMARY OF THE INVENTION

According to the present invention, a tool holding device includes a toolholder having a shank and a socket. The shank includes a connecting end at a first end of the toolholder adapted to connect to a power tool. The socket includes a cavity at a second end of the toolholder adapted to receive a bit. The cavity extends in the socket and defines an effective length which is a longitudinal length measured for a boundary wall of the cavity which is adapted to abut a peripheral wall of the bit. The socket also includes an annular wall having a first slot and a second slot cut into a region of the annular wall which corresponds to where the effective length of the cavity is measured. An aperture is defined in the second slot and communicates with the cavity.

A hollow sleeve is disposed circumferentially outside the toolholder. The sleeve is axially and rotationally movable in relation to the toolholder and is operable to move between a first position which allows for removal of the bit and a second position which allows the bit to be securely retained in the cavity of the toolholder. The sleeve defines a first section and a second section extending from an end of the first section. A returning member is disposed circumferentially between the toolholder and the second section of the sleeve for returning the sleeve to a neutral position between the first and second positions. Moreover, the portion of the sleeve which does not surround the returning member abuts the toolholder.

A clipping member is mounted in the first and second slots and includes an embracing portion disposed about the first slot. A retaining portion is received in the second slot, is inserted in the aperture, and is partially disposed in the cavity. The clipping member is selectively abutted by the first section of the sleeve. When the sleeve is at the first position, the first section of the sleeve does not abut the clipping member, and when the sleeve is at the second position, the first section of the sleeve abuts the clipping member.

A hole extends longitudinally in the socket from an end of the cavity and is in communication with the cavity. A through hole extends radially from the annular wall of the socket to the hole and is in communication with the hole. A pusher is disposed in the hole and includes a lateral side having a longitudinally extended recess with two stopping ends at a proximal end and a distal end thereof respectively. A detent is disposed in the through hole and is partially received by the recess. A resilient member is disposed in the hole as to bias the pusher in the hole. The pusher facilitates removal of the bit.

In another embodiment of the present invention, the tool holding device includes a magnet disposed in the socket for attracting the bit.

Preferably, the socket is made of stainless steel, i.e. austenitic stainless steel, in order that the socket does not scatter the magnetic force of the magnet.

Preferably, the pusher is made of copper, so that the pusher does not scatter the magnetic force of the magnet.

It is an object of the present invention that the tool holding device effectively reduces demand of using an elongated bit.

It is another object of the present invention that the sleeve is axially and rotatably movable in relation to the housing.

It is a further object of the present invention that the clipping member prevents the bit from falling out of the tool holding device due to gravity.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

BRIEF DESCRIPTION OF THE DRAWINGS

The present invention wilt be described with reference to the accompanying drawings which assist in illustrating the pertinent features thereof, in which.

DETAILED DESCRIPTION OF THE PREFERRED EMBODIMENT

Figure 1:
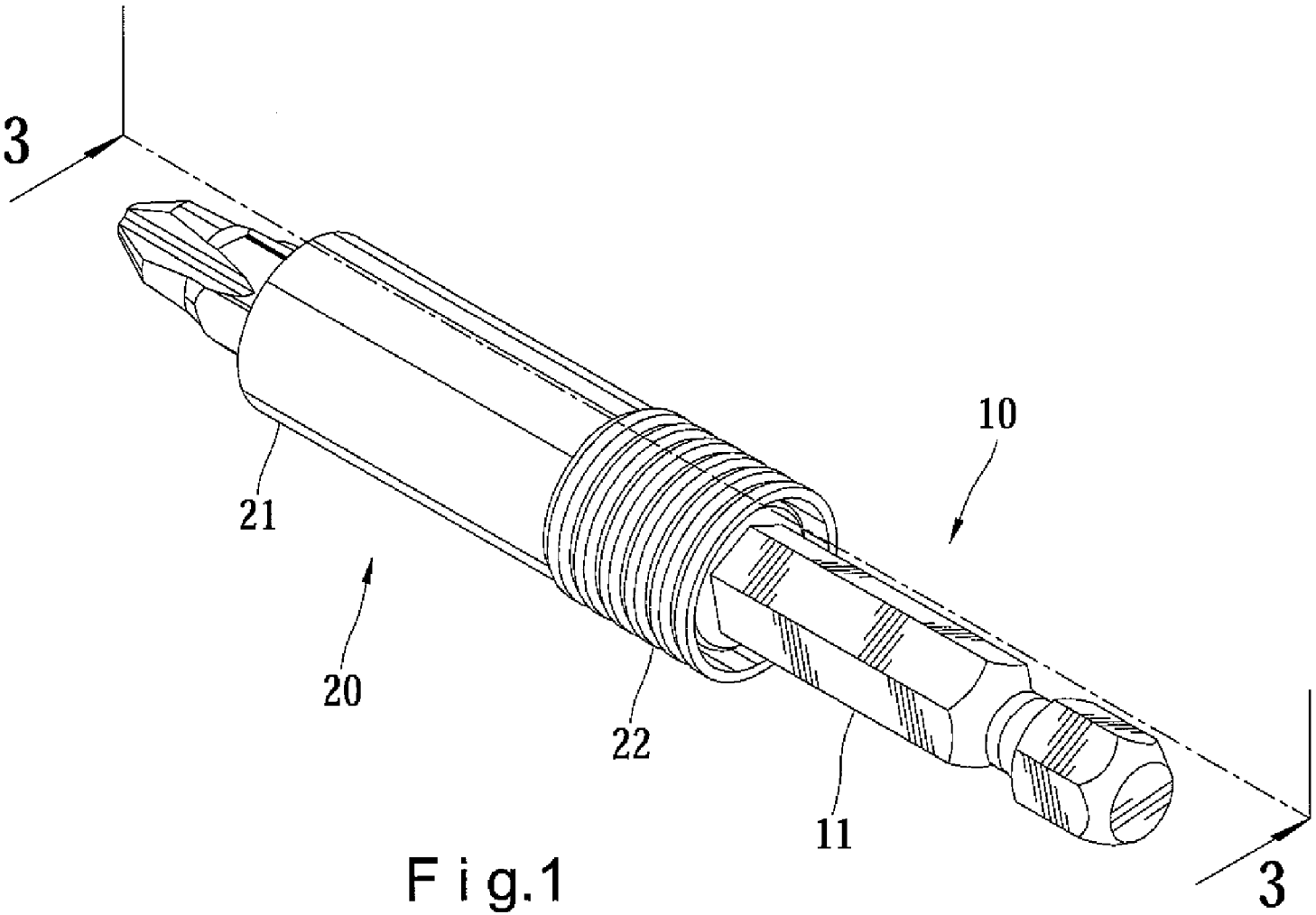
FIG. 1 is a perspective view of a tool holding device in accordance with a first embodiment of the present invention and a bit received in the tool holding device.
Figure 2:
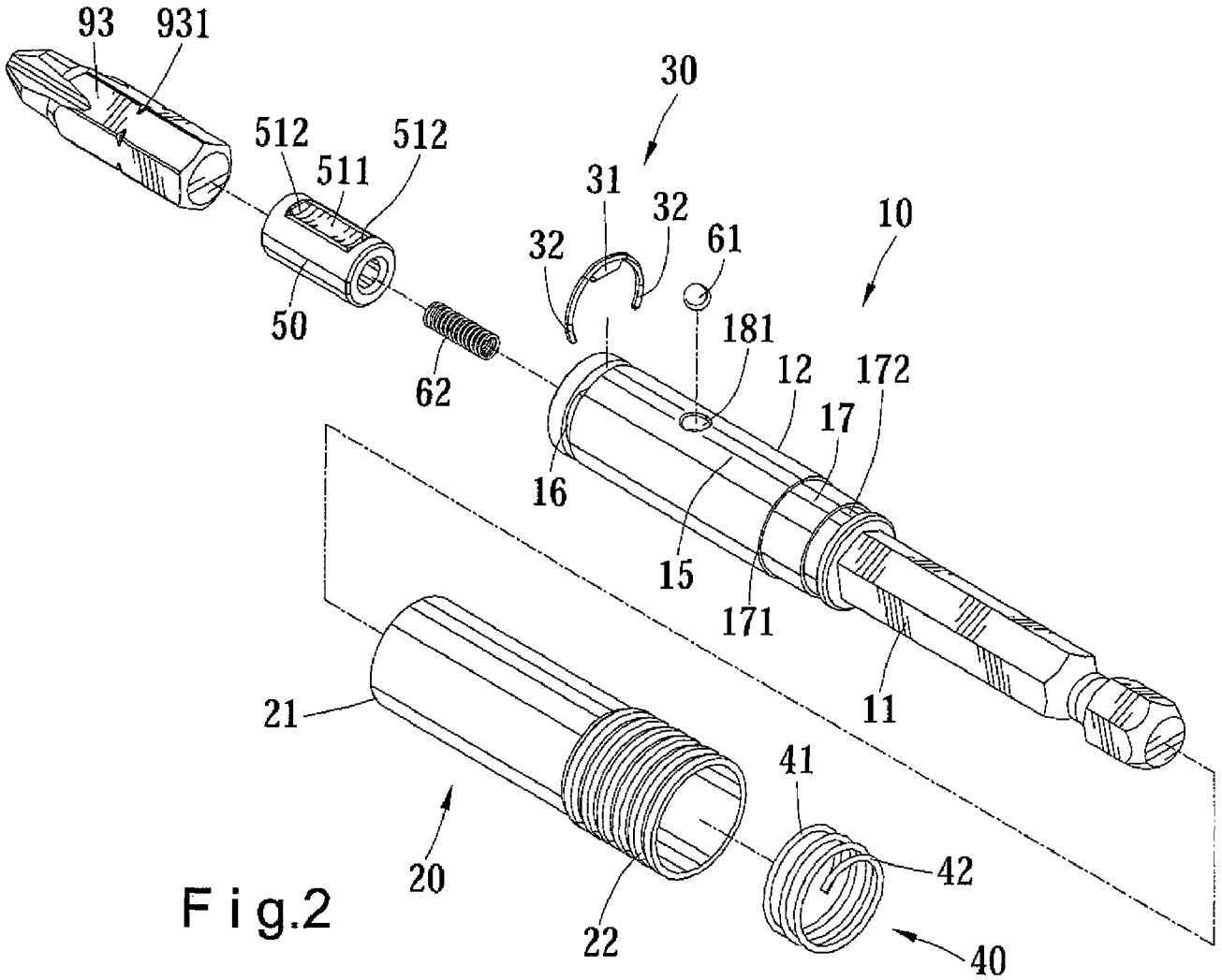
FIG. 2 is an exploded perspective view of FIG. 1.
Figure 3:
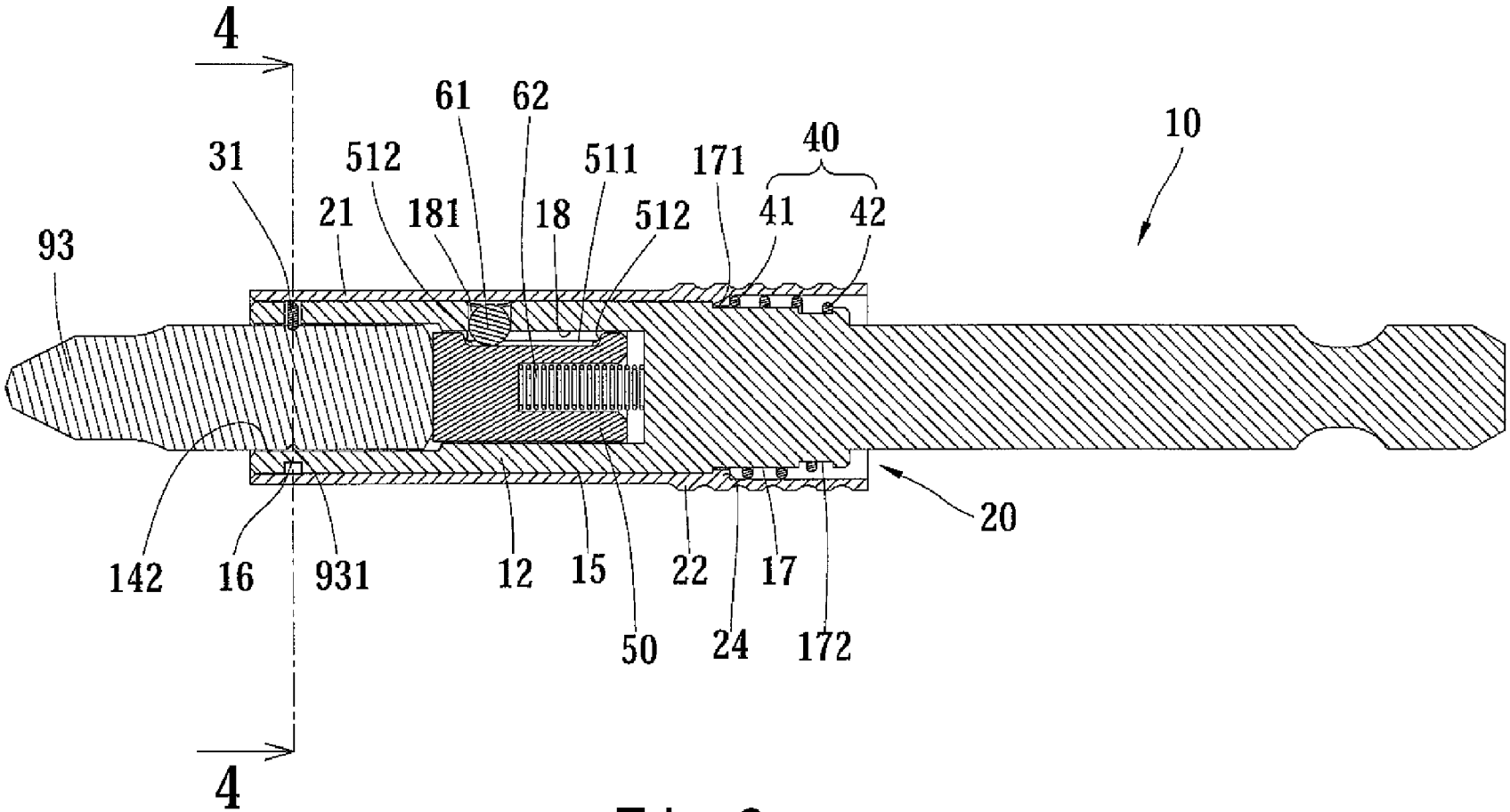
FIG. 3 is a cross-sectional view taken along line 3-3 of FIG. 1.
Figure 5:
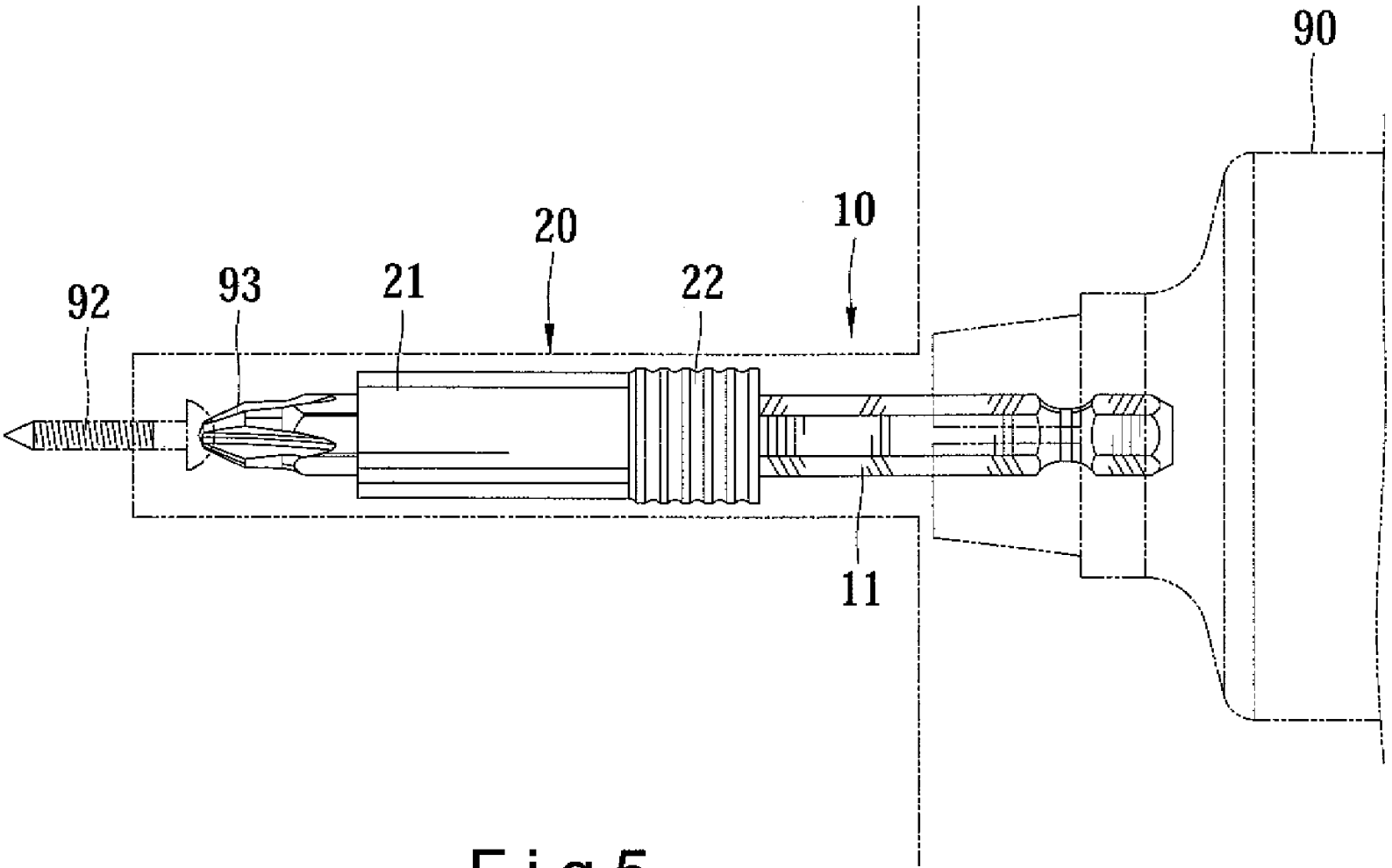
FIG. 5 is a side view illustrating the tool holding device in FIG. 1 connected to a power tool, with the power tool shown in phantom. The tool holding device is inserted in a hole and the bit is adapted to drive a fastener located within the hole, with the fastener shown in phantom.
Figure 6:
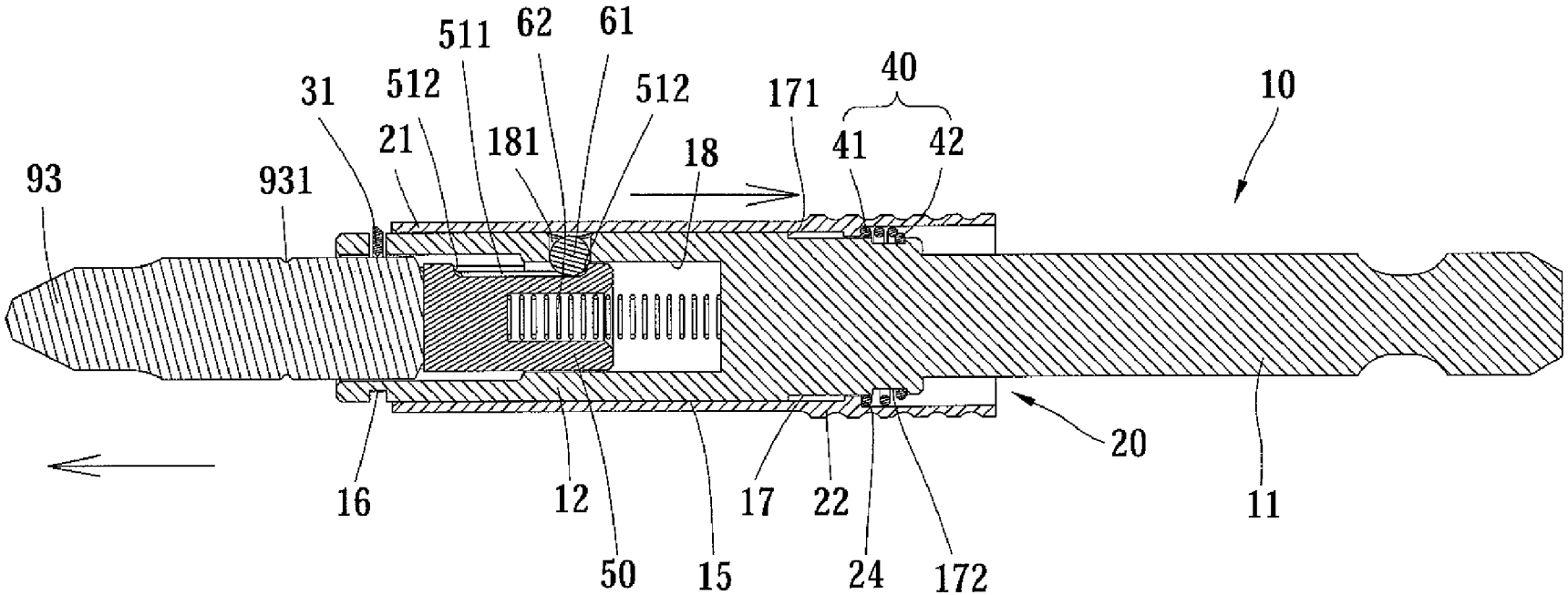
FIG. 6 is a cross-sectional view illustrating a sleeve of the tool holding device in FIG. 1 operated to allow removal of the bit from the tool holding device.

FIGS. 1 though 7 show a tool bit holding device in accordance with a first embodiment of the present invention The tool bit holding device includes a toolholder 10 having a shank 11 and a socket 12 integrally formed therewith. The shank 11 includes a connecting end at a first end of the toolholder 10 adapted to connect to a power tool 90, as shown in FIG. 5. The socket 12 includes a cavity 14 at a second end of the toolholder 10 adapted to receive a bit 93. The cavity 14 includes six faces encompassing a boundary wall, with each two of the six faces defining an included angle substantially equal to 120° at a corner. The cavity 14 extends in the socket 12 and defines an effective length L which is a longitudinal length measured for the boundary wall of the cavity 14 adapted to abut a peripheral wall of the bit 93.

The socket 12 also includes an annular wall 15 having a first slot 16 and a second slot 161 cut into a region of the annular wall, and an aperture 162 is defined in the second slot 161 and communicates with the cavity 14. Additionally, the aperture 162 is disposed about one of the corners.

A hollow sleeve 20 is disposed circumferentially outside the toolholder 10. The sleeve 20 is axially and rotationally movable in relation to the toolholder 10 and is operable to move between a first position which allows for removal of the bit 93 and a second position which allows the bit 93 to be securely retained in the cavity 14 of the toolholder 10. The sleeve 20 includes an inner peripheral edge which circumferentially abuts the annular wall 15 of the socket 12 and an outer peripheral edge. The sleeve 20 defines a first section 21 and a second section 22 extending from an end of the first section 21. The first section 21 includes a circular cross section and has an uniform internal diameter and an uniform external diameter with respect to a center of the cavity 14. In this case, the boundary wall of the cavity 14 defines a plurality of corners, i.e. six, and the center of the cavity 14 is a point where the six corners are equally spaced therefrom. The internal diameter is measured from the inner peripheral edge of the sleeve 20 to the center of the cavity 14. The external diameter is measured from the outer peripheral edge of the sleeve 20 to the center of the cavity 14. Moreover, the outer peripheral edge of the second section 22 is preferably ridged as to allow a user to hold the sleeve 20 securely during operation thereof.

A returning member 40 is disposed circumferentially between the toolholder 10 and the second section 22 of the sleeve 20 for returning the sleeve 20 to a neutral position between the first and second positions. In this embodiment, the returning member 40 is disposed on an engaging portion 17 defined on the annular wall 15 of the socket 12. The engaging portion 17 includes a first shoulder and a second shoulder 171, 172 at a proximal end and a distal end thereof respectively. The second section 22 of the sleeve 20 includes a ridge 24 extending from the inner peripheral edge thereof and toward the engaging portion 17. The ridge 24 is supported by the first shoulder 171. Additionally, the returning member 40 includes a first end 41 supported by the ridge 24 and a second end 42 supported by the second shoulder 172.

Optionally, the first end 41 has a cross section greater than that of the second end 42.

Figure 7A:
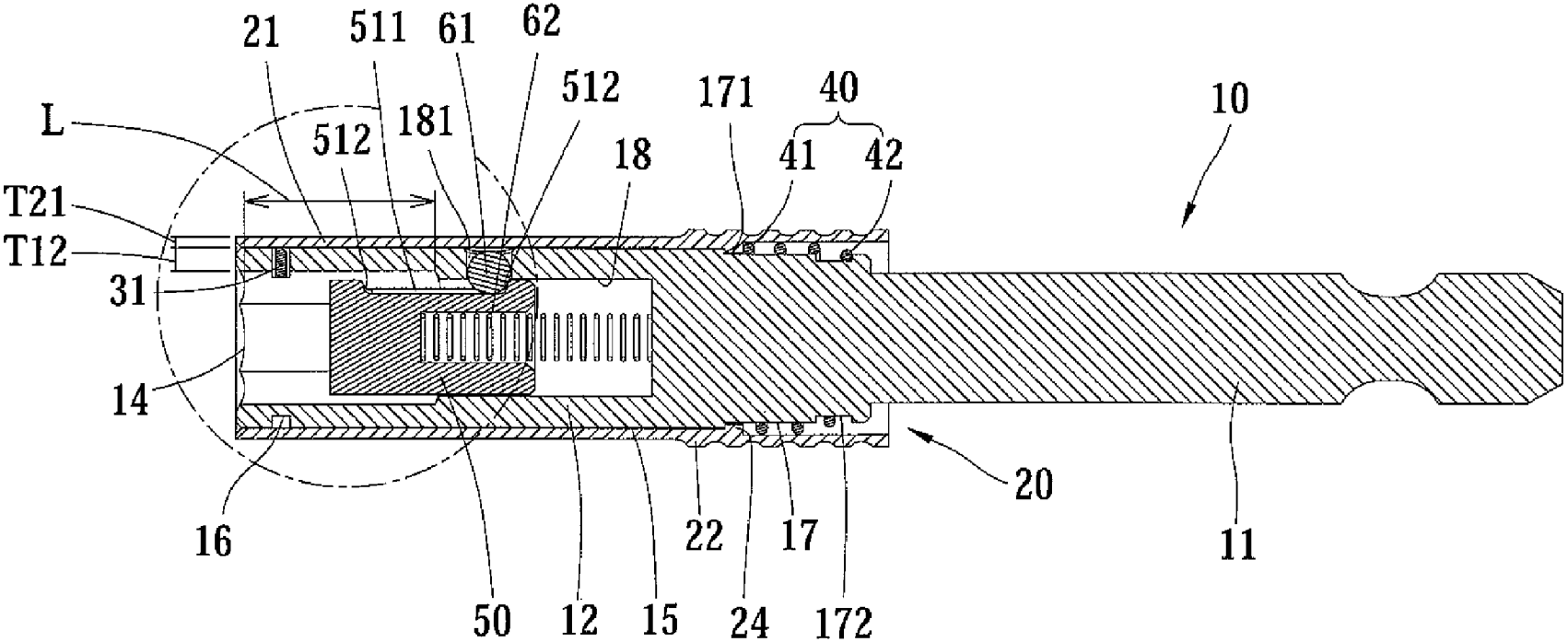
FIG. 7A is a cross-sectional view of the tool holding device in FIG. 1.
Figure 7B:
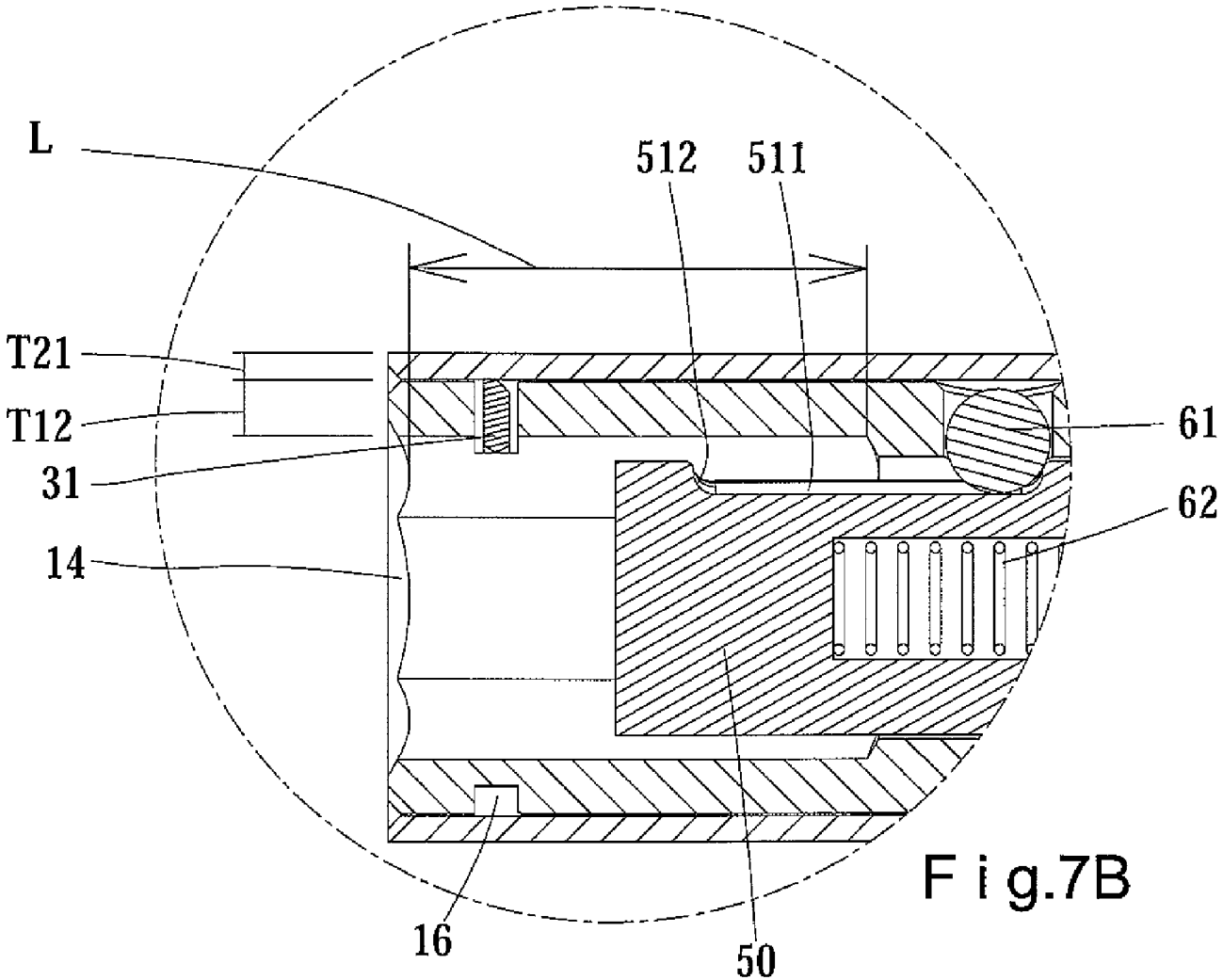
FIG. 7B is a partial, enlarged view of FIG. 7.

Moreover, the portion of the sleeve 20 which does not surround the returning member 40 abuts the toolholder 10. Referring to FIGS. 7A and 7B, the first section 21 of the sleeve 20 includes a sleeve region corresponding to where the effective length L of the cavity 14 is measured including a thickness T21 measured from the inner peripheral edge to the outer peripheral edge thereof. The socket 12 includes a socket region corresponding to where the effective length L of the cavity 14 is measured including a minimum distance T12 equal to a first length measured from the center of the cavity 14 to the annular wall 15 of the socket 12 subtracted by a second distance measured from the center of the cavity 14 to one corner of the cavity 14, with thickness T21 being less than distance T12. With this configuration, the tool holding device is adapted to be inserted into a narrow hole to drive a fastener 92, as shown in FIG. 5. It is appreciated that the tool holding device, therefore, can be made with a smaller cross section than any those taught by the prior art.

A clipping member 30, preferably made of metal, is mounted in the first and second slot: 16 and 161 and includes an embracing portion 32 disposed about the first slot 16. A retaining portion 31 is received in the second slot 161, is inserted in the aperture 162, and is partially disposed in the cavity 14. The clipping member 30 is selectively abutted by the first section 21 of the sleeve 20. Specifically, when the sleeve 20 is at the first position, the first section 21 of the sleeve 20 does not abut the clipping member 30. When the sleeve 20 is at the second position, the first section 21 of the sleeve 20 abuts the clipping member 30. Note that when the sleeve 20 is at the first position, the retaining portion 31 of the clipping member 30 can abut the received bit 93, particularly one of the cutouts 931 on the bit 93, in order that the bit 93 is prevented from falling out of the tool holding device due to gravity. Also, when the sleeve 20 is at the second position, the retaining portion 31 of the clipping member 30 is restrained in movement by the first section 21 of the sleeve 20. Thereby, the tool holding device securely holds the bit 93.

Figure 4:
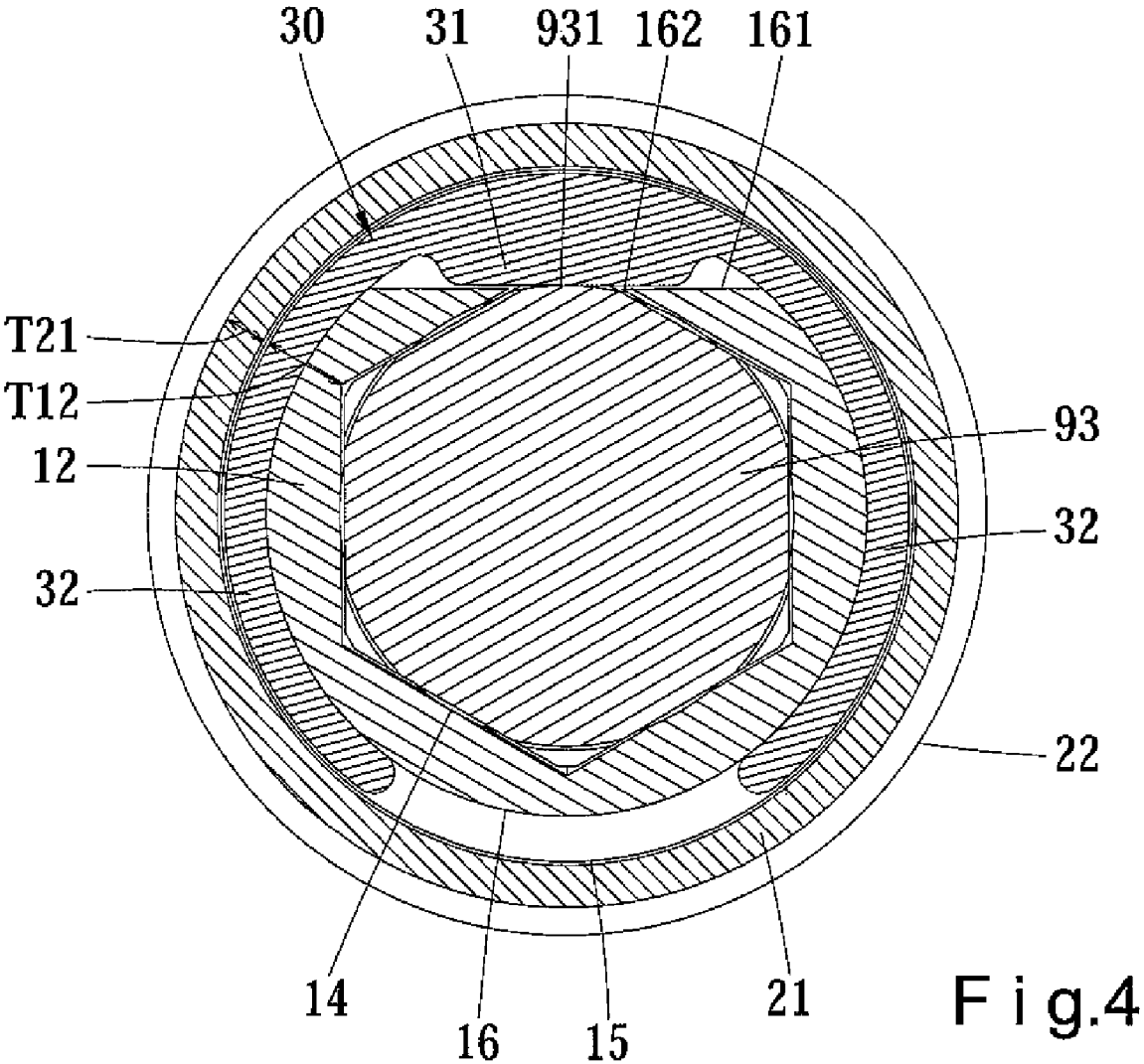
FIG. 4 is a cross-sectional view taken along line 4-4 of FIG. 3.

FIG. 4 shows that the annular wall 15 of the socket 12 includes an arcuate area defining the first slot 16 and a flat area defining the second slot 161. The first slot 16 is contiguous with the second slot 161. The clipping member 30 includes two embracing portions 32 interconnected by the retaining portion 31. The two embracing portions 32 are arcuate and are received in the first slot 16. The retaining portion 31 has a bow-shaped edge which includes an arcuate side and a flat side received in the second slot 161.

In addition, the socket 12 defines a center where the annular wall 15 is equally spaced from the center, and the clipping member 30 defines an arc length having an angle with respect to the center of the socket 12 greater than 180°.

A hole 18 extends longitudinally in the socket 12 from an end of the cavity 14 and is in communication with the cavity 14. A through hole 181 extends radially from the annular wall 15 of the socket 12 to the hole 18 and is in communication with the hole 18. A pusher 50 is disposed in the hole 18 and includes a lateral side having a longitudinally extended recess 511 with two stopping ends 512 at a proximal end and a distal end thereof respectively. A detent 61 is disposed in the through hole 181 and is partially received by the recess 511. A resilient member 62 is disposed in the hole 18 as to bias the pusher 50 in the hole. In this embodiment, the pusher 50 facilitates removal of the bit 93.

Figure 8:
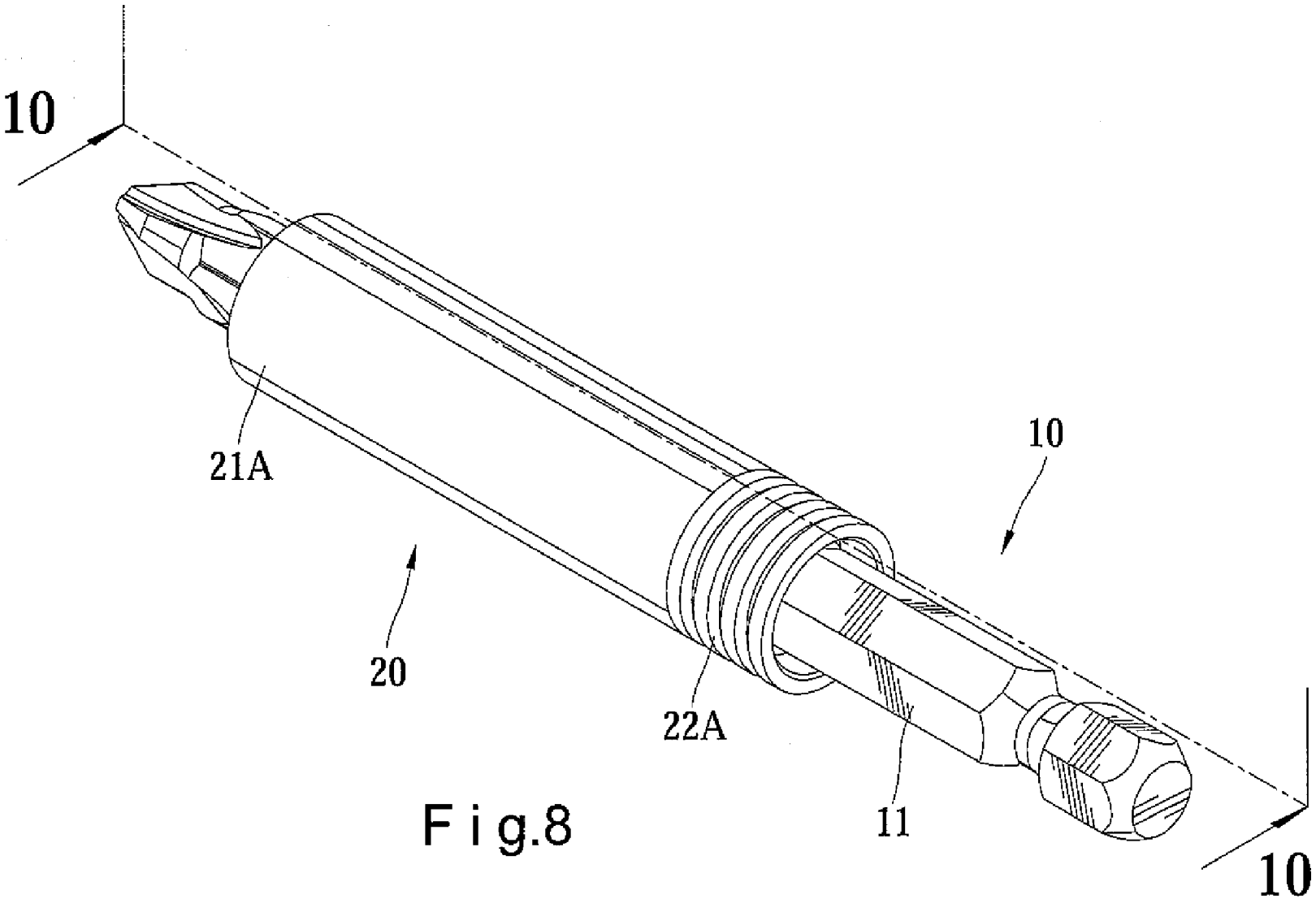
FIG. 8 is a perspective view of a tool holding device in accordance with a second embodiment of the present invention and a bit received in the tool holding device.
Figure 9:
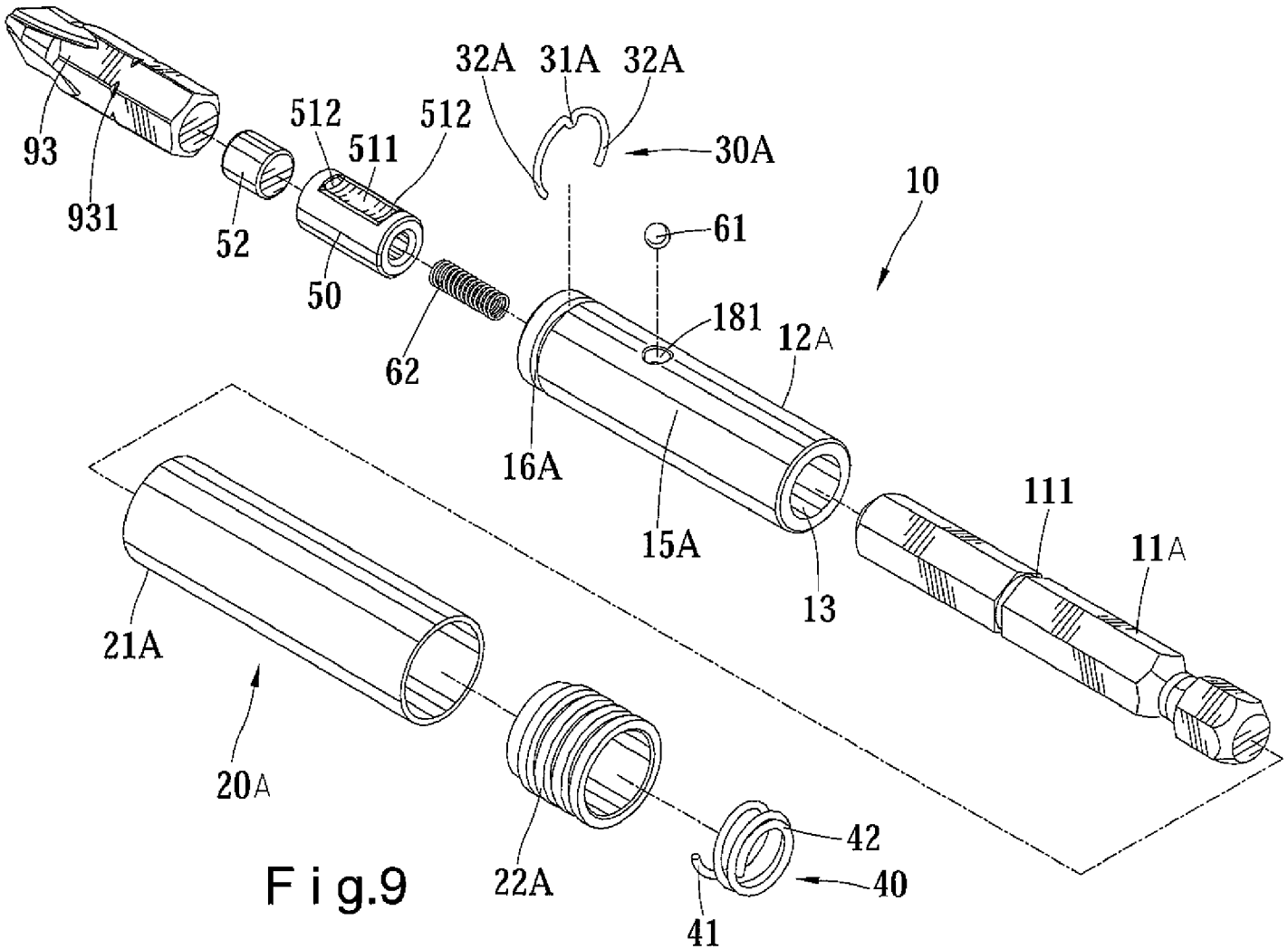
FIG. 9 is an exploded perspective view of FIG. 8.
Figure 10:
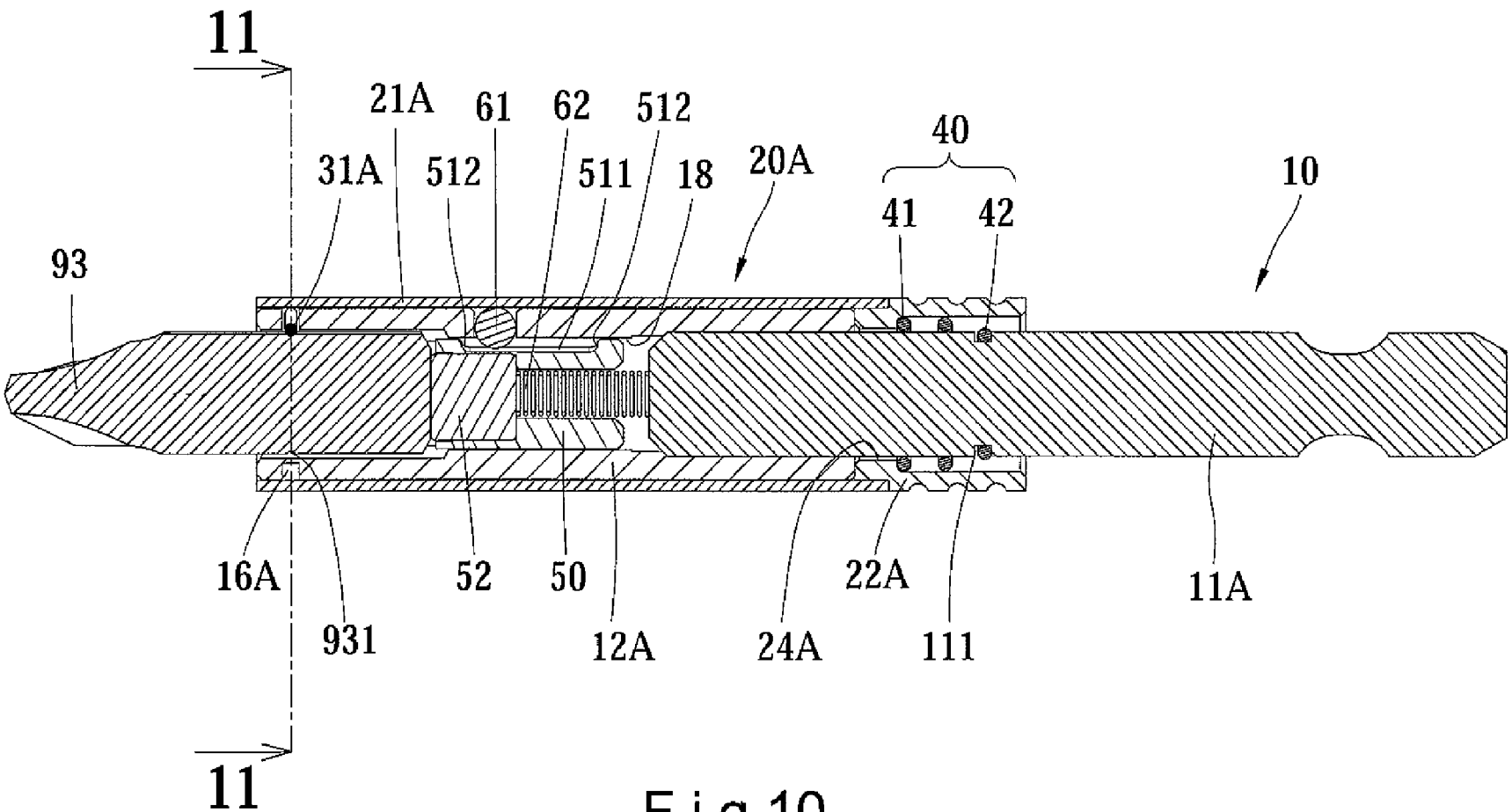
FIG. 10 is a cross-sectional view taken along line 10-10 of FIG. 8.
Figure 11:
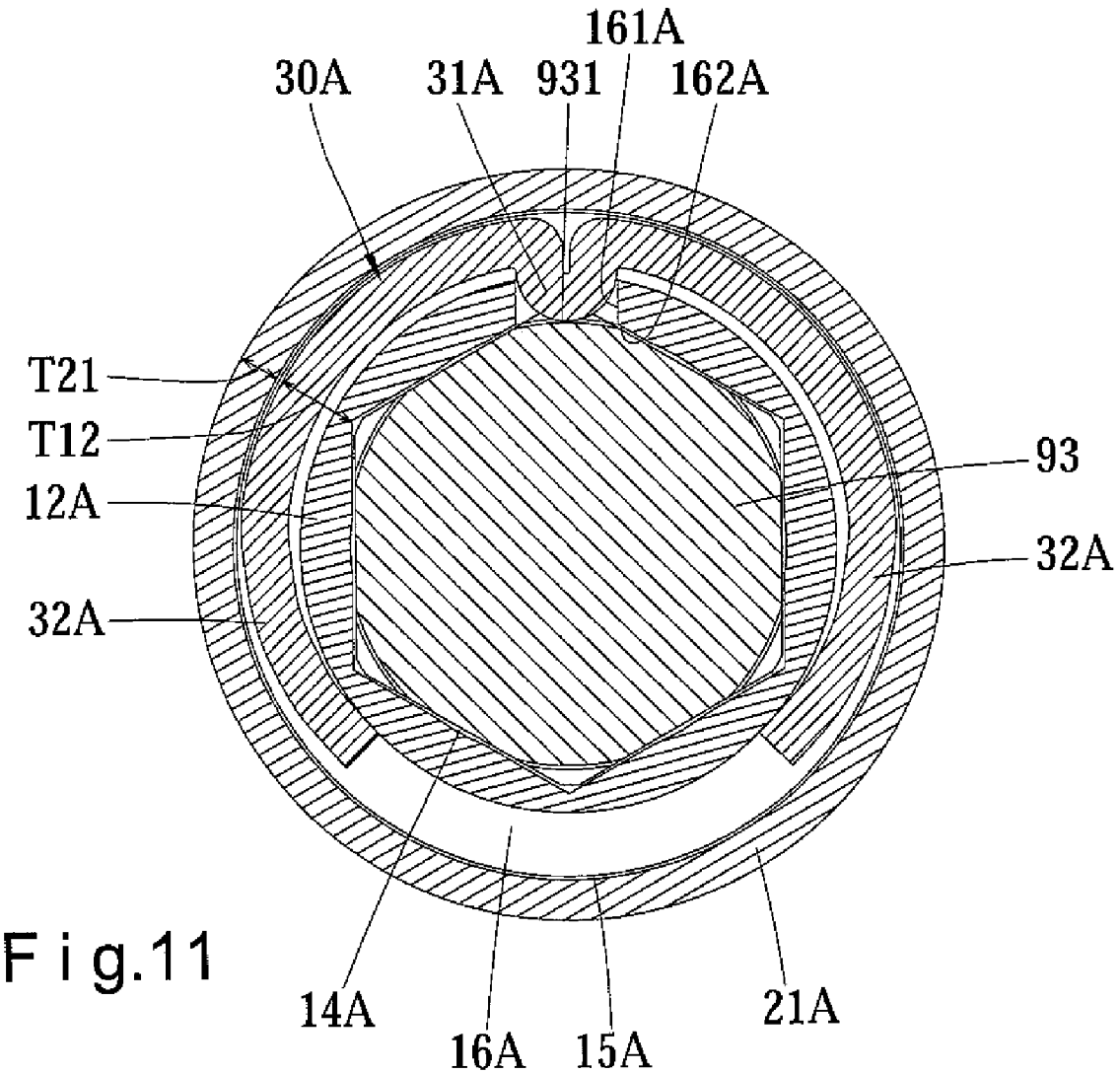
FIG. 11 is a cross-sectional view taken along line 11-11 of FIG. 10.
Figure 12:
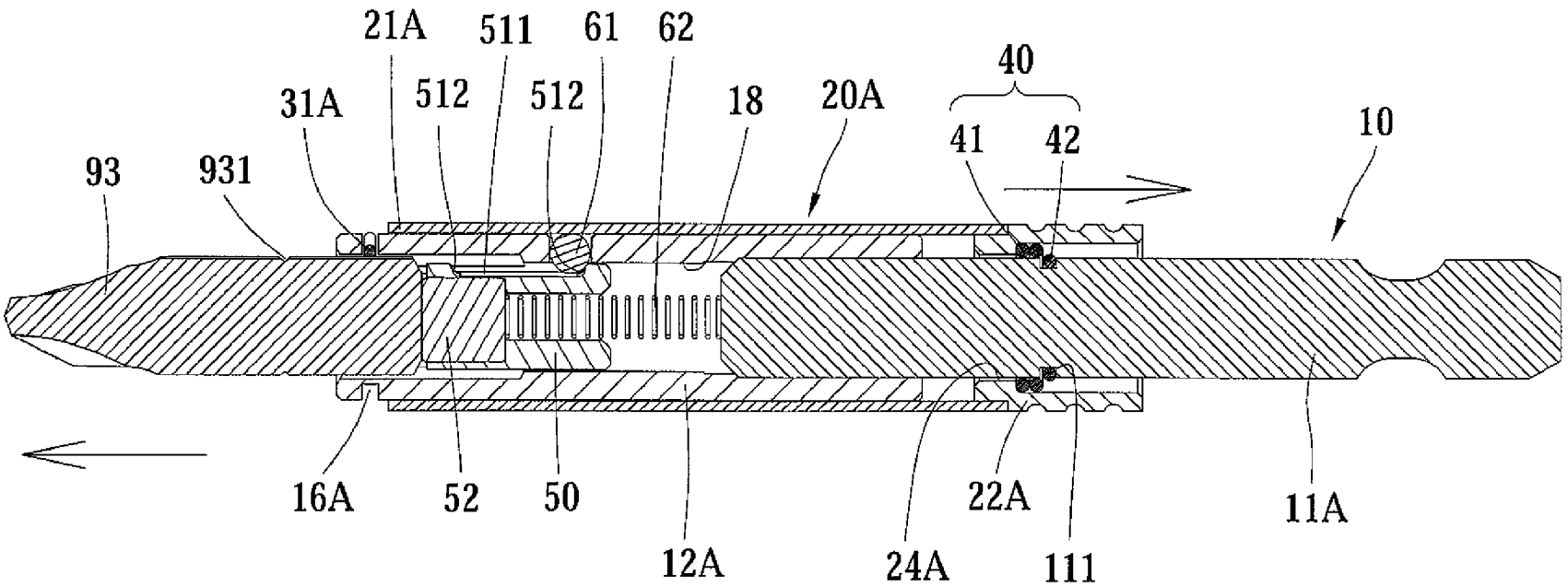
FIG. 12 is a cross-sectional view illustrating a sleeve of the tool holding device in FIG. 8 operated to allow removal of the bit from the tool holding device.
Figure 13A:
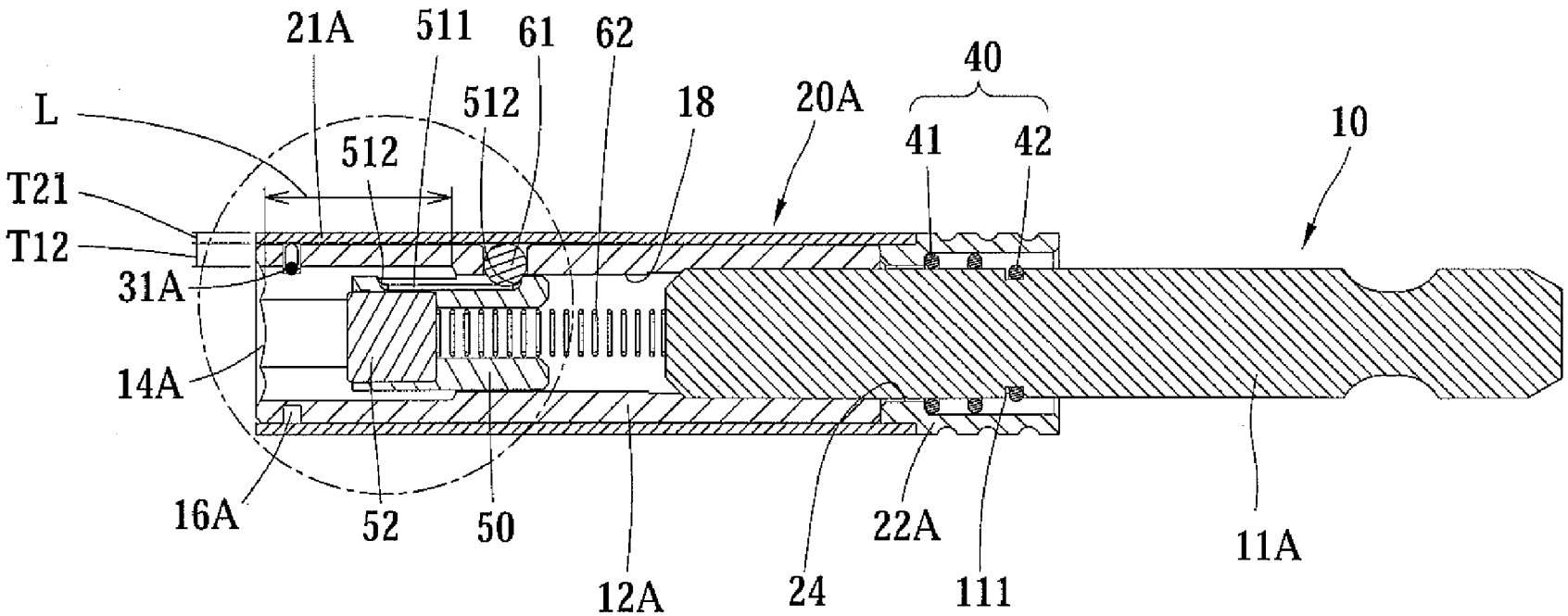
FIG. 13A is a cross-sectional view of the tool holding device in FIG. 8.
Figure 13B:
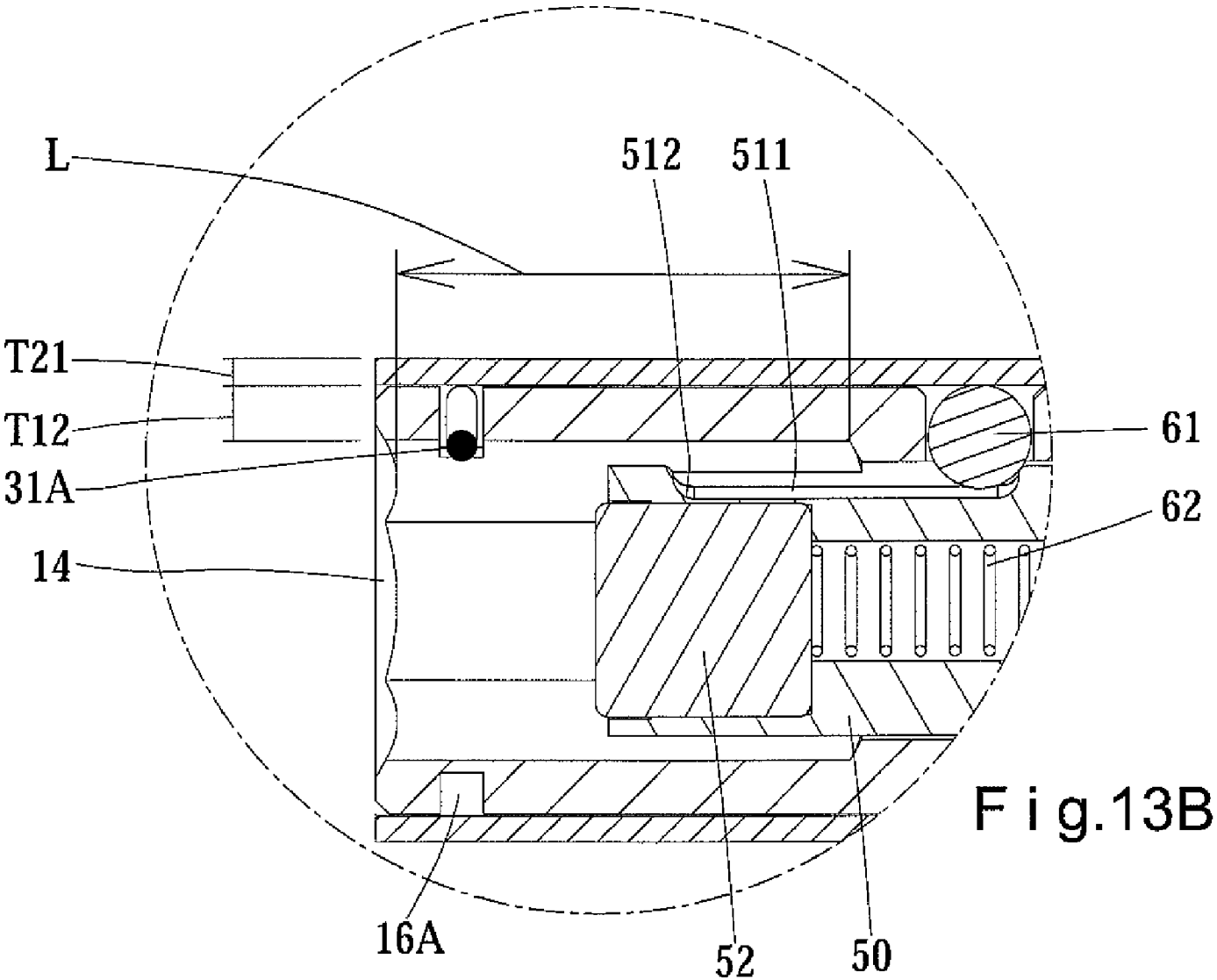
FIG. 13B is a partial enlarged view of FIG. 13.

FIGS. 8 though 13 show a tool bit holding device in accordance with a second embodiment of the present invention. It is noted that like numerals are employed to denote like components of the prior embodiment, however, bearing a letter. This embodiment differentiates from the first embodiment in that a shank 11A is insertably installed in a tunnel 13 defined in a socket 12A. The tunnel 13 has a circular cross section and defines a diameter. The shank 11A defines a length measured from two diagonally opposed corners. The length is marginally smaller than the diameter so that the shank 11A is securely connected with the socket 12A. Further, a sleeve 20A includes a first section 21A and a second section 22A releasably mounted to the first section 21A. Further, the returning member 40 is disposed on the shank 11A. Specifically, the shank 11A includes a groove 111, and the second section 22A of the sleeve 20A includes a ridge 24A extending therefrom toward the shank 11A. The first end 41 of the returning member 40 is supported by the ridge 24, while the second end 42 of the returning member 40 is disposed in the groove 111. Further, a magnet 52 is disposed at an end of the socket 12A for attracting the bit 93.

Additionally, the socket 12A includes a cavity 14A and an annular wall 15A having an arcuate area defining a first slot 16A. A second slot 161A extends radially from the first slot 16A toward the cavity 14A, and an aperture 162A is defined in the second slot 161 and communicates with the cavity 14A. Further, a clipping member 30A includes two embracing portions 32A interconnected by one retaining portion 31A. The two embracing portions 32A are arcuate and are received in the first slot 16A. The retaining portion 31A has a U-shaped edge and is received in the second slot 161A.

The socket 12A also includes a center where the annular wall 15A is equally spaced from the center, and the clipping member 30A defines an arc length having an angle with respect to the center of the socket 12A greater than 180°.

Figure 14:
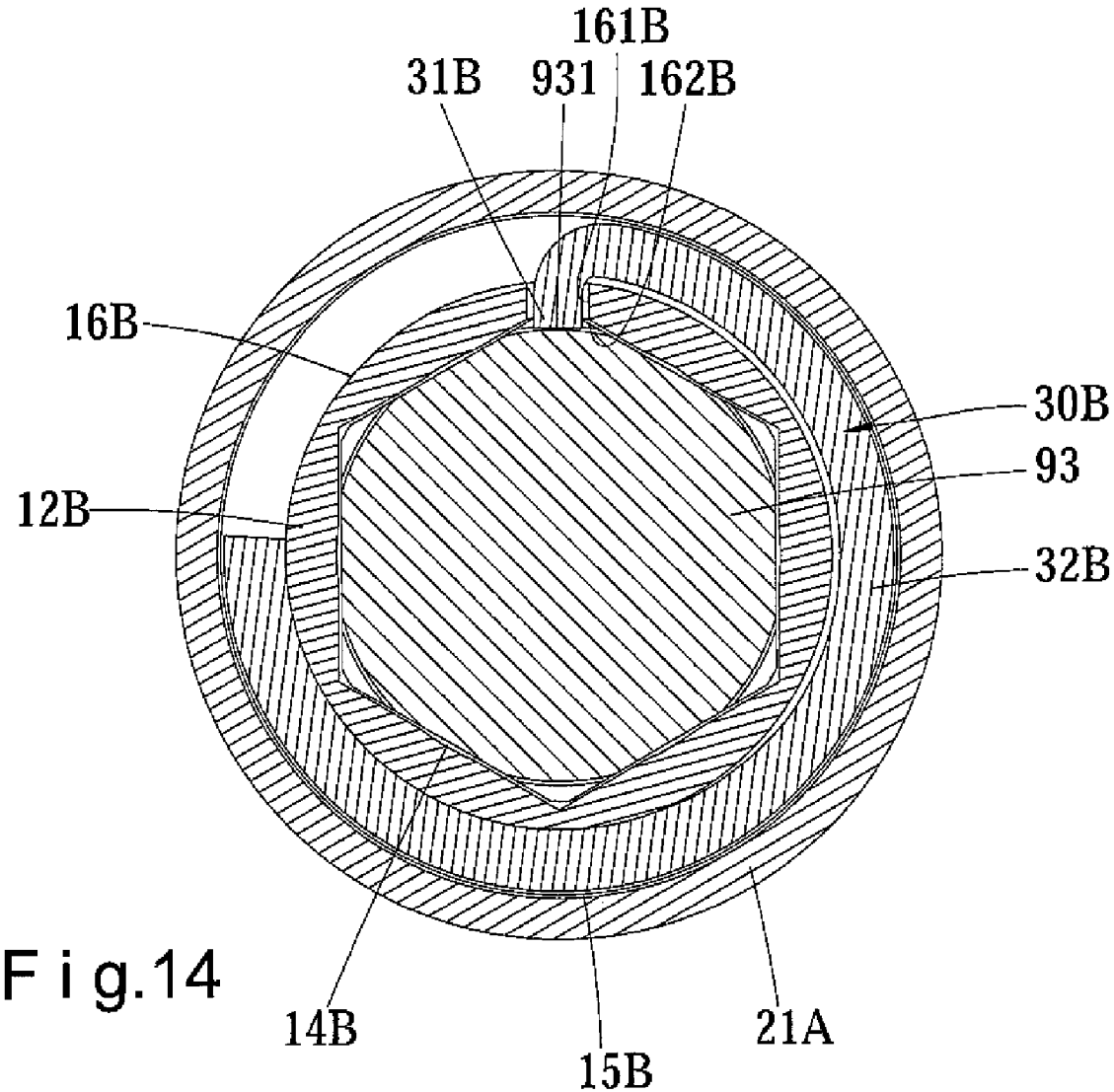
FIG. 14 is a cross-sectional view of a tool holding device in accordance with a third embodiment of the present invention and a bit received in the tool holding device.

FIG. 14 shows a tool bit holding device in accordance with a third embodiment of the present invention. It is noted that like numerals are employed to denote like components of the first embodiment, however, bearing a letter. This embodiment differentiates from the first and/or second embodiments in that a socket 12B includes a cavity 14B and an annular wall 15B having an arcuate area defining a first slot 16B. A second slot 161B extends radially from the first slot 16B toward the cavity 14, and an aperture 162B is defined in the second slot 161B and communicates with the cavity 14B. Further, a clipping member 30B includes an embracing portion 32B connected at an end of a retaining portion 31B. The embracing portion 32B is arcuate and is received in the first slot 16B. The retaining portion 31B has an inverted J-shaped edge received in the second slot 161B.

The socket 12B also comprises a center where the annular wall 15B is equally spaced from the center, and the clipping member 30B defines an arc length having an angle with respect to the center of the socket 12B greater than 180°.

Figure 15:
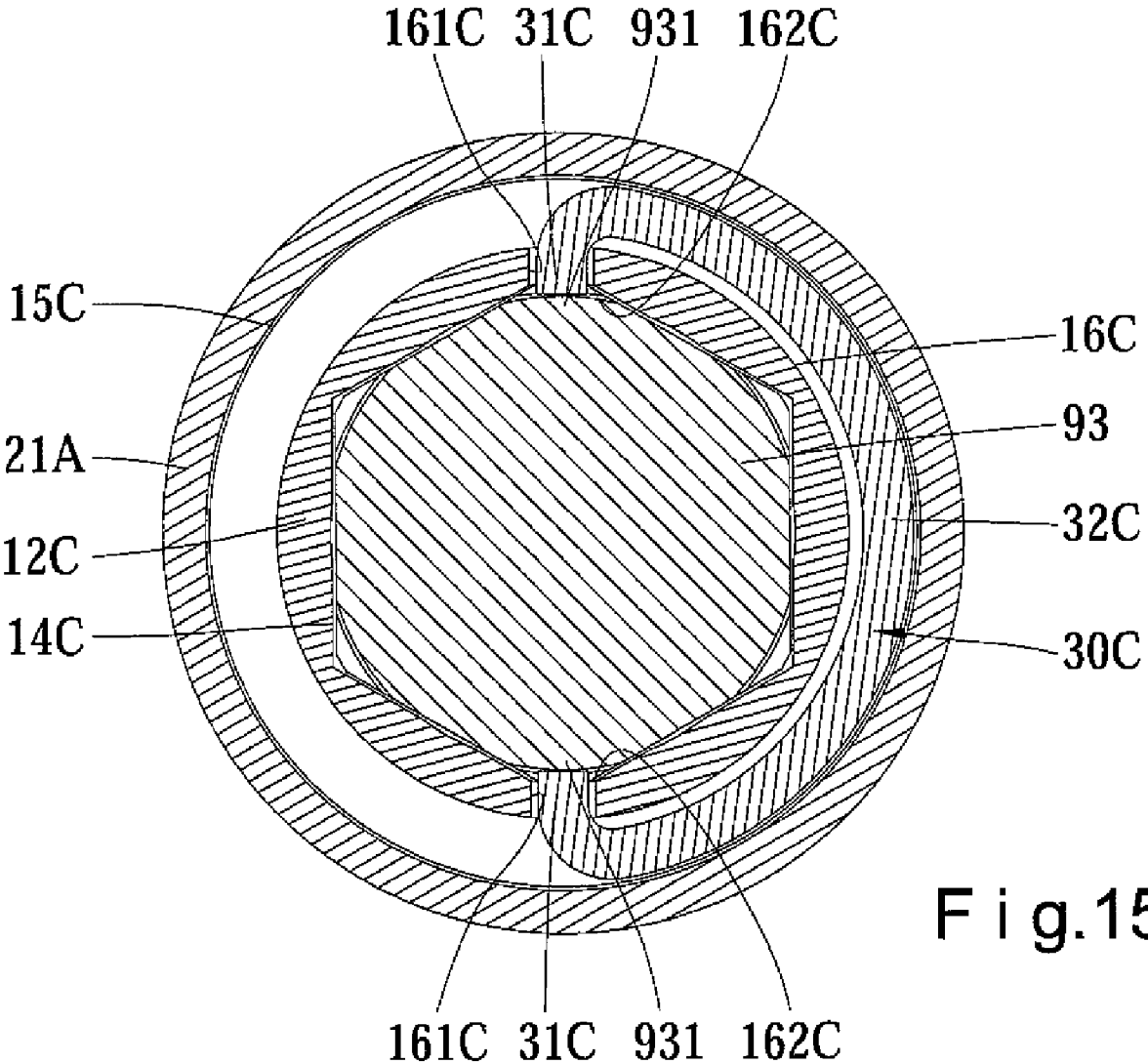
FIG. 15 is a cross-sectional view of a tool holding device in accordance with a fourth embodiment of the present invention and a bit received in the tool holding device.

FIG. 15 shows a tool bit holding device in accordance with a fourth embodiment of the present invention. It is noted that like numerals are employed to denote like components of the first embodiment, however, bearing a letter. This embodiment differentiates from the first and/or second embodiments in that a socket 12C includes a cavity 14C and an annular wall 15C having an arcuate area defining a first slot 16C. Two opposing second slots 161C extend radially from the first slot toward the cavity 14C, and two apertures 162C are defined in the second slots 161C and communicate with the cavities 14C respectively. Further, a clipping member 30C includes two retaining portions 31C interconnected by an embracing portion 32C. Each of the two retaining portions 31C has an inverted J-shaped edge received in the two second slots 161C respectively. The embracing portion 32C is arcuate and is disposed about the first slot 16C.

The socket 12C also includes a center where the annular wall 15C is equally spaced from the center, and the clipping member 30C defines an arc length having an angle with respect to the center of the socket 12C substantially equaling to 180°.

Figure 16:
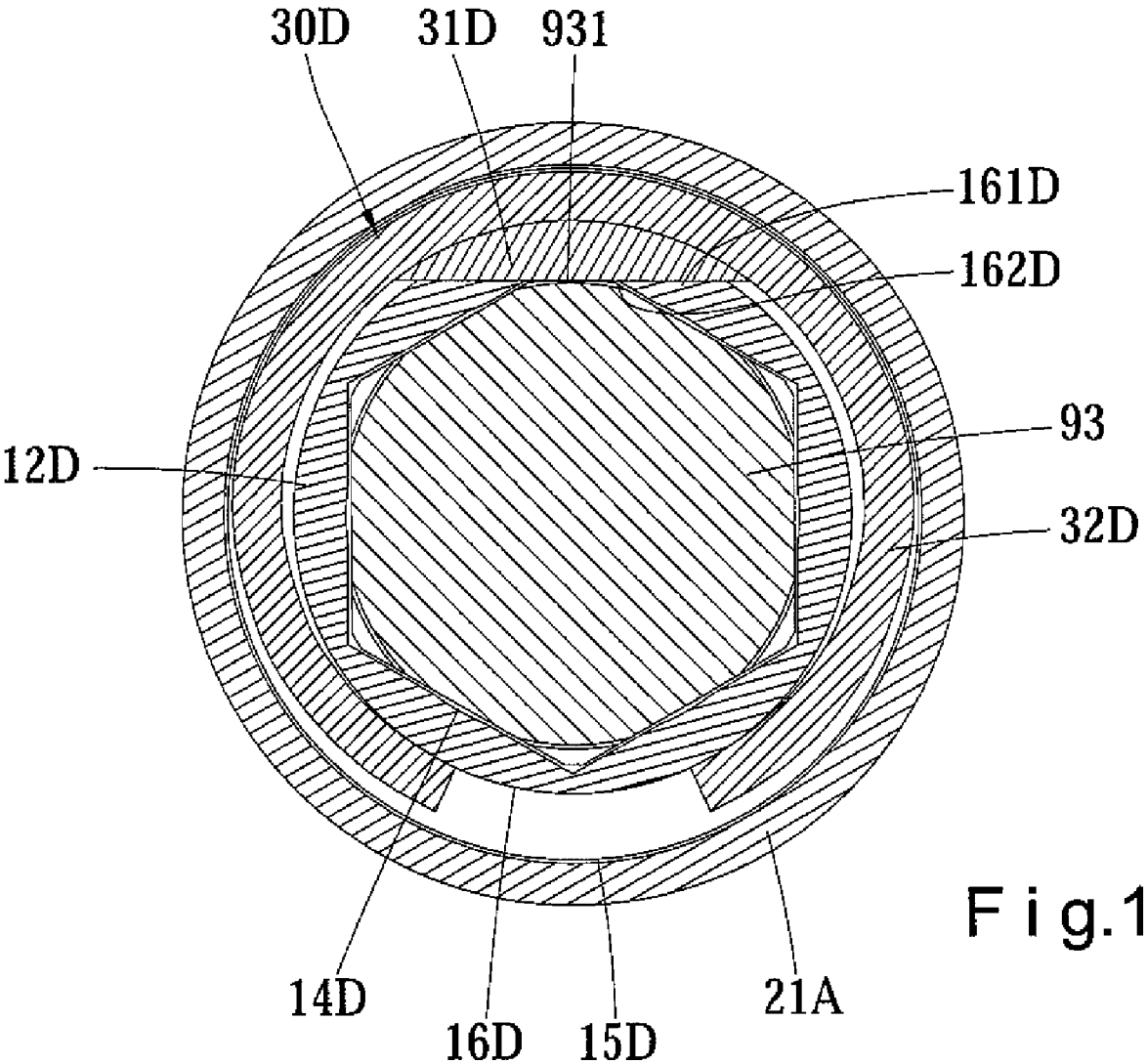
FIG. 16 is a cross-sectional view of a tool holding device in accordance with a fifth embodiment of the present invention and a bit received in the tool holding device.

FIG. 16 shows a tool bit holding device in accordance with a fifth embodiment of the present invention. It is noted that like numerals are employed to denote like components of the first embodiment, however, bearing a letter. This embodiment differentiates from the first and/or second embodiments in that a socket 12D includes a cavity 14D and an annular wall 15D having an arcuate area defining a first slot 16D and a flat area defining the second slot 161D. An aperture 162D is defined in the second slot 161D and communicates with the cavity 14D. The first slot 16D is contiguous with the second slot 161D. The clipping member 30D includes a retaining portion 31D and an embracing portion 32D abutting the retaining portion 31D. The retaining portion 31D has a bow-shaped edge which includes an arcuate side and a flat side received in the second slot 161D. The embracing portion 32D is arcuate and is received in the first slot 16D.

The socket 12D also include a center where the annular wall 15D is equally spaced from the center, and the embracing portion 32D defines an arc length having an angle with respect to the center of the socket 12D greater than 180°.

Figure 17:
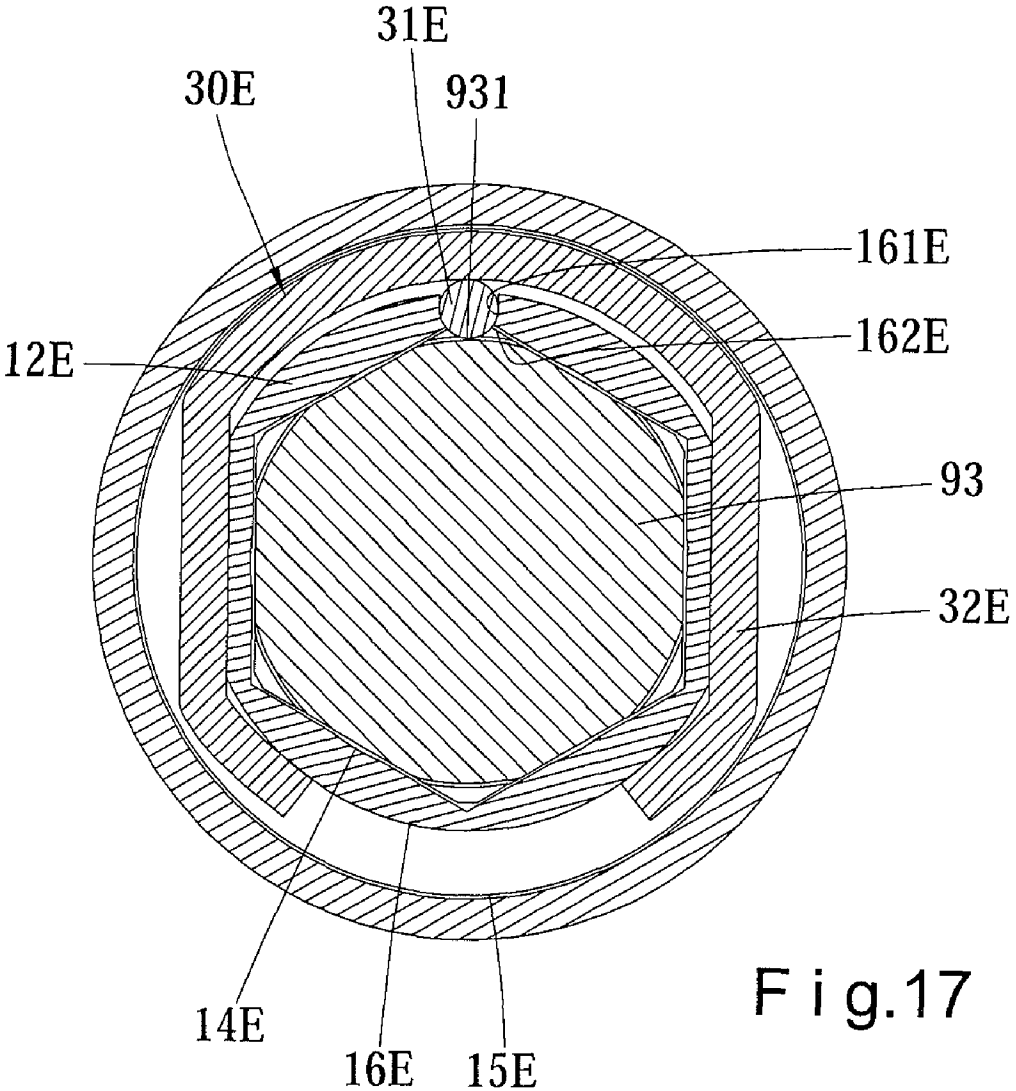
FIG. 17 is a cross-sectional view of a tool holding device in accordance with a sixth embodiment of the present invention and a bit received in the tool holding device.

FIG. 17 shows a tool bit holding device in accordance with a sixth embodiment of the present invention. It is noted that like numerals are employed to denote like components of the first embodiment, however, bearing a letter. This embodiment differentiates from the first and/or second embodiments in that a socket 12E includes a cavity 14E and an annular wall 15E having two opposing arcuate areas and two opposing flat areas defining a first slot 16E. A second slot 161E extends radially from the first slot 16E toward the cavity 14E, and an aperture 162E is defined in the second slot 161 and communicates with the cavity 14E. The clipping member 30E includes a retaining portion 31E and an embracing portion 32E abutting the retaining portion 31E. The retaining portion 31E has a ball-shaped edge and is received in the second slot 161E. The embracing portion 32E has two first flat sides received in the flat areas of the first slot 16E respectively, an arcuate side between the two flat sides, and two substantially second flat sides extending from an end of the two first flat sides respectively.

The socket 12E also includes a center where the annular wall 15E is equally spaced from the center, and the embracing portion 32E defines an arc length having an angle with respect to the center of the socket 12E greater than 180°.

Moreover, it is advantageous that the socket 12A, 12B, 12C, 12D, 12E is made of stainless steel, i.e. austenitic stainless steel, in order that the socket 12A, 12B, 12C, 12D, 12E does not scatter the magnetic force of the magnet 52.

Moreover, the pusher 50 is made of copper, so that the pusher 50 does not scatter the magnetic force of the magnet 52.

While the specific embodiments have been illustrated and described, numerous modifications come to mind without significantly departing from the spirit of invention, and the scope of invention is only limited by the scope of the accompanying claims.

What is claimed is:

1. A tool holding device comprising:

a toolholder including a shank and a socket, the shank having a connecting end defined at a first end of the toolholder adapted to connect to a power tool, the socket having a cavity defined at a second end of the toolholder adapted to receive a bit, the cavity extending in the socket and defining an effective length which is a longitudinal length measured for a boundary wall of the cavity which is adapted to abut a peripheral wall of the bit, the socket further having an annular wall, a first slot and a second slot cut into a region of the annular wall, and an aperture is defined in the second slot and communicates with the cavity;

a sleeve being hollow and disposed circumferentially outside the toolholder, the sleeve being axially and rotationally movable in relation to the toolholder, the sleeve being operable to move between a first position which allows for removal of the bit and a second position which allows the bit to be securely retained in the cavity of the toolholder, the sleeve defining a first section and a second section extending from an end of the first section, the sleeve further including a returning member disposed circumferentially, between the toolholder and the second section thereof for returning the sleeve to a neutral position between the first and second positions, and with a portion of the sleeve which does not surround the returning member abutting the toolholder; and a clipping member mounted in the first and second slots and having an embracing portion disposed about the first slot and a retaining portion received in the second slot, with the clipping member inserted in the aperture and partially disposed in the cavity, the clipping member being selectively abutted by the first section of the sleeve, and wherein when the sleeve is at the first position, the first section of the sleeve does not abut the clipping member, and wherein when the sleeve is at the second position, the first section of the sleeve abuts the clipping member, wherein the sleeve comprises an inner peripheral edge which circumferentially abuts the annular wall of the socket and an outer peripheral edge, and wherein the first section of the sleeve comprises a sleeve region corresponding to where the effective length of the cavity is measured including a thickness measured from the inner peripheral edge to the outer peripheral edge thereof, and wherein the boundary wall of the cavity defines a plurality of corners and a center equal distanced with respect to the plurality of corners, and wherein the socket comprises a socket region corresponding to where the effective length of the cavity is measured including a minimum distance equaling to a first length measured from the center of the cavity to the annular wall of the socket subtracted by a second distance measured from the center of the cavity to one of the plurality of corners of the cavity, and wherein the thickness of the sleeve is less than the minimum distance.

2. The tool holding device as claimed in claim 1 wherein the first section of the sleeve comprises a circular cross section and has an uniform internal diameter and an uniform external diameter with respect to the center of the cavity, with the internal diameter measured from the inner peripheral edge of the sleeve to the center of the cavity, and with the external diameter measured from the outer peripheral edge of the sleeve to the center of the cavity.

3. The tool holding device as claimed in claim 1 wherein the returning member is disposed on an engaging portion defined on the annular wall of the socket, and wherein the engaging portion comprises a first shoulder and a second shoulder at a proximal end and a distal end thereof respectively, and wherein the second section of the sleeve comprises a ridge extending therefrom towards the engaging portion, and with the ridge being supported by the first shoulder, and wherein the returning member comprises a first end supported by the ridge and a second end supported by the second shoulder.

4. The tool holding device as claimed in claim 1 wherein the returning member is disposed on the shank, and wherein the shank comprises a non-circular peripheral wall and a groove cut circumferentially into the peripheral wall, and wherein the second section of the sleeve comprises a ridge extending therefrom towards the peripheral wall of the shank, and wherein the returning member comprises a first end supported by the ridge and a second end disposed in the groove.

5. The tool holding device as claimed in claim 1 wherein the annular wall of the socket comprises an arcuate area defining the first slot and a flat area defining the second slot, with the first slot contiguous with the second slot, and wherein the clipping member comprises two embracing portions interconnected by the retaining portion, with the two embracing portions being arcuate and received in the first slot, with the retaining portion having a bow-shaped edge which includes an arcuate side and a flat side received in the second slot and partially disposed in the cavity, whereby the bit is frictionally retained by the clipping member when the sleeve is at the first position, and wherein the socket comprises a center, with the annular wall equally spaced from the center, and wherein the clipping member defines an arc length having an angle with respect to the center of the socket greater than 180°.

6. The tool holding device as claimed in claim 1 wherein the annular wall of the socket comprises an arcuate area defining the first slot, and with the second slot extending radially from the first slot towards the cavity, and wherein the clipping member comprises two embracing portions interconnected by the retaining portion, with the two embracing portions being arcuate and received in the first slot, with the retaining portion having a U-shaped edge received in the second slot and partially disposed in the cavity, whereby the bit is frictionally retained by the clipping member when the sleeve is at the first position, and wherein the socket comprises a center, with the annular wall equally spaced from the center, and wherein the clipping member defines an arc length having an angle with respect to the center of the socket greater than 180°.

7. The tool holding device as claimed in claim 1 wherein the annular wall of the socket comprises an arcuate area defining the first slot, and with the second slot extending radially from the first slot towards the cavity, and wherein the embracing portion is connected at an end of the retaining portion, with the embracing portion being arcuate and received in the first slot, with the retaining portion having an inverted J-shaped edge received in the second slot and partially disposed in the cavity, whereby the bit is frictionally retained by the clipping member when the sleeve is at the first position, and wherein the socket comprises a center, with the annular wall equally spaced from the center, and wherein the clipping member defines an arc length having an angle with respect to the center of the socket greater than 180°.

8. The tool holding device as claimed in claim 1 wherein the annular wall of the socket comprises an arcuate area defining the first slot, and wherein the socket comprises two opposing second slots extending radially from the first slot toward the cavity, and wherein the clipping member comprises two retaining portions interconnected by the embracing portion, with each of the two retaining portions having an inverted J-shaped edge received in the two second slots and partially disposed in the cavity, whereby the bit is frictionally retained by the clipping member when the sleeve is at the first position respectively, with the embracing portion being arcuately disposed about the first slot, and wherein the socket comprises a center, with the annular wall equally spaced from the center, and wherein the clipping member defines an arc length having an angle with respect to the center of the socket substantially equal to 180°.

9. The tool holding device as claimed in claim 1 wherein the annular wall of the socket comprises two opposing arcuate areas and two opposing flat areas defining the first slot, and with the second slot extending radially from the first slot towards the cavity, and wherein the retaining portion is abutted by the embracing portion, with the retaining portion having a ball-shaped edge received in the second slot and partially disposed in the cavity, whereby the bit is frictionally retained by the clipping member when the sleeve is at the first position, with the embracing portion having two first flat sides received in the flat areas of the first slot respectively, an arcuate side between the two flat sides, and two second substantially flat sides extending from an end of the two first flat sides respectively, and wherein the socket comprises a center, with the annular wall equally spaced from the center, and wherein the embracing portion defines an arc length having an angle with respect to the center of the socket greater than 180°.

10. The tool holding device as claimed in claim 1 wherein the shank comprises a hexagonal cross section, and wherein the shank is insertably installed in a tunnel defined in the socket, with the tunnel having a circular cross section, and wherein the tunnel in the socket defines a diameter and the shank defines a length measured from two diagonally opposed corners marginally smaller than the diameter so that the shank is securely connected with the socket.

11. The tool holding device as claimed in claim 1 wherein the cavity comprises six faces encompassing the boundary wall, with the boundary wall defining six corners, with each two of the six faces defining an included angle substantially equal to 120°, and wherein the aperture is disposed about one of the six corners.

12. A tool holding device comprising:

a toolholder including a shank and a socket, the shank having a connecting end defined at a first end of the toolholder adapted to connect to a power tool, the socket having a cavity defined at a second end of the toolholder adapted to receive a bit, the cavity extending in the socket and defining an effective length which is a longitudinal length measured for a boundary wall of the cavity which is adapted to abut a peripheral wall of the bit, the socket further having an annular wall, a first slot and a second slot cut into a region of the annular wall, and an aperture is defined in the second slot and communicates with the cavity;

a sleeve being hollow and disposed circumferentially outside the toolholder, the sleeve being axially and rotationally movable in relation to the toolholder, the sleeve being operable to move between a first position which allows for removal of the bit and a second position which allows the bit to be securely retained in the cavity of the toolholder, the sleeve defining a first section and a second section extending from an end of the first section, the sleeve further including a returning member disposed circumferentially between the toolholder and the second section thereof for returning the sleeve to a neutral position between the first and second positions, and with a portion of the sleeve which does not surround the returning member abutting the toolholder; and a clipping member mounted in the first and second slots and having an embracing portion disposed about the first slot and a retaining portion received in the second slot, with the clipping member inserted in the aperture and partially disposed in the cavity, the clipping member being selectively abutted by the first section of the sleeve, and wherein when the sleeve is at the first position, the first section of the sleeve does not abut the clipping member, and wherein when the sleeve is at the second position, the first section of the sleeve abuts the clipping member, wherein the socket comprises a hole extending longitudinally therein from an end of the cavity and communicating with the cavity, and wherein the socket further comprises a through hole extending radially from the annular wall of the socket to the hole and communicating with the hole, and wherein the hole includes a pusher disposed therein, and wherein the pusher comprises a lateral side having a longitudinally extended recess with two stopping ends at a proximal end and a distal end thereof respectively, and wherein the pusher includes a detent disposed in the through hole and partially received by the recess and a resilient member disposed in the hole as to bias the pusher in the hole.

13. The tool holding device as claimed in claim 12 wherein the pusher comprises a magnet mounted at an end thereof for attracting the bit.

14. The tool holding device as claimed in claim 13 wherein the pusher is made of copper and the socket is made of stainless steel.

15. The tool holding device as claimed in claim 14 wherein the annular wall of the socket comprises an arcuate area defining the first slot and a flat area defining the second slot, with the first slot contiguous with the second slot, and wherein the clipping member comprises two embracing portions interconnected by the retaining portion, with the two embracing portions being arcuate and received in the first slot, with the retaining portion having a bow-shaped edge which includes an arcuate side and a flat side received in the second slot and partially disposed in the cavity, whereby the bit is frictionally retained by the clipping member when the sleeve is at the first position, and wherein the socket comprises a center, with the annular wall equally spaced from the center, and wherein the clipping member defines an arc length having an angle with respect to the center of the socket greater than 180°.

16. The tool holding device as claimed in claim 14 wherein the annular wall of the socket comprises an arcuate area defining the first slot, and with the second slot extending radially from the first slot towards the cavity, and wherein the clipping member comprises two embracing portions interconnected by the retaining portion, with the two embracing portions being arcuate and received in the first slot, with the retaining portion having a U-shaped edge received in the second slot and partially disposed in the cavity, whereby the bit is frictionally retained by the clipping member when the sleeve is at the first position, and wherein the socket comprises a center, with the annular wall equally spaced from the center, and wherein the clipping member defines an arc length having an angle with respect to the center of the socket greater than 180°.

17. The tool holding device as claimed in claim 14 wherein the annular wall of the socket comprises an arcuate area defining the first slot, and with the second slot extending radially from the first slot towards the cavity, and wherein the embracing portion is connected at an end of the retaining portion, with the embracing portion being arcuate and received in the first slot, with the retaining portion having an inverted J-shaped edge received in the second slot and partially disposed in the cavity, whereby the bit is frictionally retained by the clipping member when the sleeve is at the first position, and wherein the socket comprises a center, with the annular wall equally spaced from the center, and wherein the clipping member defines an arc length having an angle with respect to the center of the socket greater than 180°.

18. The tool holding device as claimed in claim 14 wherein the annular wall of the socket comprises an arcuate area defining the first slot, and wherein the socket comprises two opposing second slots extending radially from the first slot toward the cavity, and wherein the clipping member comprises two retaining portions interconnected by the embracing portion, with each of the two retaining portions having an inverted J-shaped edge received in the two second slots and partially disposed in the cavity, whereby the bit is frictionally retained by the clipping member when the sleeve is at the first position respectively, with the embracing portion being arcuately disposed about the first slot, and wherein the socket comprises a center, with the annular wall equally spaced from the center, and wherein the clipping member defines an arc length having an angle with respect to the center of the socket substantially equal to 180°.

19. The tool holding device as claimed in claim 14 wherein the annular wall of the socket comprises an arcuate area defining the first slot and an flat area defining the second slot, with the first slot contiguous with the second slot, and wherein the retaining portion is abutted by the embracing portion, with the retaining portion having a bow-shaped edge which includes an arcuate side and a flat side received in the second slot and partially disposed in the cavity, whereby the bit is frictionally retained by the clipping member when the sleeve is at the first position, with the embracing portion being arcuate and received in the first slot, and wherein the socket comprises a center, with the annular wall equally spaced from the center, and wherein the embracing portion defines an arc length having an angle with respect to the center of the socket greater than 180°.

20. The tool holding device as claimed in claim 14 wherein the annular wall of the socket comprises two opposing arcuate areas and two opposing flat areas defining the first slot, and with the second slot extending radially from the first slot towards the cavity, and wherein the retaining portion is abutted by the embracing portion, with the retaining portion having a ball-shaped edge received in the second slot and partially disposed in the cavity, whereby the bit is frictionally retained by the clipping member when the sleeve is at the first position, with the embracing portion having two first flat sides received in the flat areas of the first slot respectively, an arcuate side between the two flat sides, and two second substantially flat sides extending from an end of the two first flat sides respectively, and wherein the socket comprises a center, with the annular wall equally spaced from the center, and wherein the embracing portion defines an arc length having an angle with respect to the center of the socket greater than 180°.

21. A tool holding device comprising:

a toolholder including a shank and a socket, the shank having a connecting end defined at a first end of the toolholder adapted to connect to a power tool, the socket having a cavity defined at a second end of the toolholder adapted to receive a bit, the cavity extending in the socket and defining an effective length which is a longitudinal length measured for a boundary wall of the cavity which is adapted to abut a peripheral wall of the bit, the socket further having an annular wall, a first slot and a second slot cut into a region of the annular wall, and an aperture is defined in the second slot and communicates with the cavity;

a sleeve being hollow and disposed circumferentially outside the toolholder, the sleeve being axially and rotationally movable in relation to the toolholder, the sleeve being operable to move between a first position which allows for removal of the bit and a second position which allows the bit to be securely retained in the cavity of the toolholder, the sleeve defining a first section and a second section extending from an end of the first section, the sleeve further including a returning member disposed circumferentially between the toolholder and the second section thereof for returning the sleeve to a neutral position between the first and second positions, and with a portion of the sleeve which does not surround the returning member abutting the toolholder; and a clipping member mounted in the first and second slots and having an embracing portion disposed about the first slot and a retaining portion received in the second slot, with the clipping member inserted in the aperture and partially disposed in the cavity, the clipping member being selectively abutted by the first section of the sleeve, and wherein when the sleeve is at the first position, the first section of the sleeve does not abut the clipping member, and wherein when the sleeve is at the second position, the first section of the sleeve abuts the clipping member, wherein the annular wall of the socket comprises an arcuate area defining the first slot and a flat area defining the second slot, with the first slot contiguous with the second slot, and wherein the retaining portion is abutted by the embracing portion, with the retaining portion having a bow-shaped edge which includes an arcuate side and a flat side received in the second slot and partially disposed in the cavity, whereby the bit is frictionally retained by the clipping member when the sleeve is at the first position, with the embracing portion being arcuate and received in the first slot, and wherein the socket comprises a center, with the annular wall equally spaced from the center, and wherein the embracing portion defines an arc length having an angle with respect to the center of the socket greater than 180°.

* * * * *